US012774131B2

(12) United States Patent
Lopez Uran et al.

(10) Patent No.: US 12,774,131 B2
(45) Date of Patent: Oct. 27, 2026

(54) REMOVEABLE SHELF FOR RIGID CONTAINERS FOR DRY GOODS

(71) Applicant: CHEP TECHNOLOGY PTY LIMITED, Sydney (AU)

(72) Inventors: Daniel Lopez Uran, London (GB); Luis Asensio Cotillas, Valencia (ES)

(73) Assignee: CHEP Technology Pty Limited, Sydney (AU)

( * ) Notice: Subject to any disclaimer, the term of this patent is extended or adjusted under 35 U.S.C. 154(b) by 121 days.

(21) Appl. No.: 18/546,823

(22) PCT Filed: Feb. 17, 2022

(86) PCT No.: PCT/GB2022/050435

§ 371 (c)(1),
(2) Date: Aug. 17, 2023

(87) PCT Pub. No.: WO2022/175668

PCT Pub. Date: Aug. 25, 2022

(65) Prior Publication Data

US 2024/0140647 A1 May 2, 2024

(30) Foreign Application Priority Data

Feb. 20, 2021 (GB) ..... 2102413

(51) Int. Cl.
*B65D 25/08* (2006.01)
*B65D 6/18* (2006.01)
(Continued)

(52) U.S. Cl.
CPC ..... *B65D 25/08* (2013.01); *B65D 11/1833* (2013.01); *B65D 11/1866* (2013.01);
(Continued)

(58) Field of Classification Search
CPC ..... B65D 25/08; B65D 11/1833; B65D 11/1866; B65D 19/18; B65D 25/005;
(Continued)

(56) References Cited

U.S. PATENT DOCUMENTS 3,836,044 A * 9/1974 Tilp ..... B65D 83/0805 206/812
4,446,982 A * 5/1984 Corse ..... A21B 3/13 249/168

(Continued)

FOREIGN PATENT DOCUMENTS

DE 8634309 3/1987
DE 102005008695 A1 8/2006

(Continued)

OTHER PUBLICATIONS

International Search Report and Written Opinion for International Application No. PCT/GB2022/050435, dated Mar. 17, 2022, (15 pages), European Patent Office, Rijswijk, Netherlands.

(Continued)

*Primary Examiner* — Kareen K Thomas
(74) *Attorney, Agent, or Firm* — Alston & Bird LLP

(57) ABSTRACT

There is disclosed a removable shelf (1) for rigid containers (100) for transporting dry goods, the removable shelf (1) comprising at least one shelf locator (10, 11) usable such that the removable shelf (1) can be attached face-to-face to a wall (101) of the containers (100), or to an intermediate removable shelf (2) attached to said wall (101). In this way, one or more removable shelves (1) can be attached to the wall of a container (100). This is particularly advantageous in the case of collapsible containers (100), whereby the removable shelves (1) can thus be neatly retained and stacked within the collapsed containers (100).

22 Claims, 8 Drawing Sheets

(51) Int. Cl.

| | |
|---|---|
| ***B65D 6/24*** | (2006.01) |
| ***B65D 19/18*** | (2006.01) |
| ***B65D 25/00*** | (2006.01) |
| ***B65D 25/06*** | (2006.01) |
| ***B65D 43/02*** | (2006.01) |

(52) U.S. Cl.

CPC ..... *B65D 19/18* (2013.01); *B65D 25/005* (2013.01); *B65D 25/06* (2013.01); *B65D 43/0202* (2013.01); *B65D 2203/00* (2013.01); *B65D 2519/00174* (2013.01); *B65D 2519/00208* (2013.01); *B65D 2519/00497* (2013.01); *B65D 2519/00502* (2013.01); *B65D 2519/00587* (2013.01); *B65D 2519/00646* (2013.01); *B65D 2519/00905* (2013.01); *B65D 2519/00995* (2013.01); *B65D 2543/00194* (2013.01)

(58) Field of Classification Search

CPC ..... B65D 25/06; B65D 43/0202; B65D 2203/00; B65D 2519/00174; B65D 2519/00208; B65D 2519/00497; B65D 2519/00502; B65D 2519/00587; B65D 2519/00646; B65D 2519/00905; B65D 2519/00995; B65D 2543/00194; B65D 2519/00034; B65D 2519/00069; B65D 2519/00333; B65D 2519/00711; B65D 2519/00805; B65D 2519/0082; B65D 2519/009; B65D 11/184; B65D 11/18; Y02W 30/80

See application file for complete search history.

(56) References Cited

U.S. PATENT DOCUMENTS

| | | | | |
|---|---|---|---|---|
| 5,868,269 | A * | 2/1999 | Juarez | B65D 25/04 220/771 |
| 7,288,745 | B2 * | 10/2007 | Colonna | F25D 3/08 62/457.6 |
| 8,342,129 | B2 * | 1/2013 | Harper | A01K 5/0114 119/61.5 |
| 8,800,795 | B2 * | 8/2014 | Hwang | A45C 7/0031 220/23.88 |
| 2006/0124498 | A1 * | 6/2006 | Flanagan | B65D 11/1833 206/503 |
| 2020/0221871 | A1 * | 7/2020 | Sisto | A47B 96/028 |

FOREIGN PATENT DOCUMENTS

| | | | |
|---|---|---|---|
| DE | 102019110836 | A1 | 10/2020 |
| EP | 2868592 | A1 | 5/2015 |
| FR | 2186076 | A5 | 1/1974 |
| JP | 2002-337979 | A | 11/2002 |
| JP | 2018199464 | A | 12/2018 |

OTHER PUBLICATIONS

United Kingdom Search Report for British Patent Application No. 2102413.8, dated Nov. 17, 2021, (4 pages), South Wales, United Kingdom.

Chinese Office Action for Application No. 202280015807.5, dated Jul. 9, 2025, 13 pages.

Japanese Office Action for Application No. 2023-550174, dated Oct. 21, 2025, 9 pages.

* cited by examiner

REMOVEABLE SHELF FOR RIGID CONTAINERS FOR DRY GOODS

CROSS REFERENCE TO RELATED APPLICATIONS

This application is a National Stage Application, filed under 35 U.S.C. § 371, of International Application No. PCT/GB2022/050435, filed Feb. 17, 2022, which international application claims priority to and the benefit of United Kingdom Application No. 2102413.8, filed Feb. 20, 2021; the contents of both of which as are hereby incorporated by reference in their entireties.

TECHNICAL FIELD

The present invention relates to a removable shelf for rigid containers for the transportation of dry goods, and to related containers and methods. More particularly, the present invention relates to a removable shelf for foldable containers for the transportation of dry goods (i.e. to containers whose otherwise rigid walls can be collapsed, at least partially, so that an empty container may be more easily returned to a service centre in a collapsed or folded configuration), and to related foldable containers and methods.

BACKGROUND

Containers are known means for transporting goods across distribution networks. These goods may include dry ingredients, components, packaging materials or packaged products, and may also include bulk goods. Containers used to transport bulk goods may be referred to as Intermediate Bulk Containers (IBCs). Containers used to transport components, other materials or products may be referred to as Foldable Large Containers (FLCs). FLCs may be particularly beneficial when pooled (i.e., when they are used as reusable containers), improving the efficiency, and cost effectiveness, of reverse logistics in the supply chain.

FLCs generally comprise a base, a body and a removable lid. The lid may be removed, and one or more walls, together forming the body of the container, may then be conveniently collapsed or folded on the base of the container. The lid may then be recovered and placed over the collapsed container so that the empty, folded container is ready to be transported back to a service centre, after use.

In an assembled state, the combination of the base, body and lid of the container define an enclosed space in which contents may be stored. One or more removable shelves may be provided to divide up the enclosed space in, for example, two or more compartments. This may allow for a more efficient use of the enclosed space, during transportation of the goods. Once the goods have been offloaded, and the shelves have been removed, the shelves should be placed in the folded container to be returned to the service centre together with the container, so that a new pooling cycle for the shelved container may begin.

The container may be described as a freight container or a transportation container. In one example, the container may have a total volume, or volumetric capacity, of around 700 litres, but a variety of sizes and geometries are otherwise available. For example, containers may have a volume of anywhere up to between around 1000 litres and around 1500 litres. The container body may be sized to correspond with a footprint of the base, which may have a size which corresponds to that of a standard pallet.

With the containers of the prior art, the removable shelves may be misplaced after removal, and may therefore never be returned to the service centre, or anyway not together with the respective container. Further, a folded container may contain one or more shelves, or none—and this information may be difficult to identify. These possibilities have the potential to have a negative impact on the efficiency of the whole supply chain, since any missing shelves may need to be replaced, resulting in additional costs which would have been otherwise avoidable.

There is therefore a need to overcome one or more of the disadvantages associated with the prior art containers.

SUMMARY OF THE INVENTION

According to an aspect of the present disclosure, there is provided a removable shelf for rigid containers for transporting dry goods, the removable shelf comprising at least one shelf locator usable such that the removable shelf can be attached face-to-face to a wall of the containers, or to an intermediate removable shelf attached to said wall.

The shelf can thus be advantageously removably attached to the container wall, optionally via another shelf already attached to the container wall, so that the removable shelf will be less likely misplaced in relation to the container.

This is particularly advantageous when the container is foldable, that is when at least one of the container walls may be folded for transportation, together with the attached removable shelf.

It will be understood that, in principle, any manner of removably attaching the shelf face-to-face to the wall (or intermediate shelf) may be considered. For example, an advantageous way of removably attaching the shelf face-to-face would be by hanging the shelf to the wall, in which case the shelf locator may be provided in the form of a hanger or hook, to hang the removable shelf from the wall of the container in the desired configuration, i.e. face-to-face, to maintain compactness and space efficiency, while minimising any risks of misplacing the shelf.

The at least one shelf locator may be provided on a face of the removable shelf. This could facilitate the face-to-face disposition of the attached shelf.

In use, the faces of the shelf may be used for supporting any goods to be transported, as opposed to any other surfaces of the shelf which would not be used for this purpose.

Preferably, the at least one shelf locator may be provided at or near a side of the shelf face, so as not to obstruct any transported goods.

Preferably, the at least one shelf locator may be provided at or near a corner of the shelf.

It will be understood that the location of the one or more shelf locators may in addition identify to a user an upper side or upper edge of the shelf, for attachment to an upper side or upper edge of the container wall or intermediate shelf.

Advantageously, there may be at least two shelf locators disposed at or near opposed ends of the shelf, respectively, for a better weight distribution of the shelf, when attached.

Preferably, the at least two shelf locators may be disposed along a side of the shelf, such as its upper side in the configuration with the shelf attached to the container (optionally via the intermediate shelf).

Preferably, the at least two shelf locators may be disposed at or near adjacent corners of the shelf.

Advantageously, the removable shelf may comprise at least one male shelf locator, and at least one complementary, female shelf locator.

It will be appreciated that the location of the male and female locators may be interchangeable, in that the male locator may be provided on the removable shelf and the female locator may be provided on the wall of the container to which the removable shelf is to be attached, or on the intermediate removable shelf already attached to said wall, or vice versa it can be the at least one female shelf locator that may be so provided.

Further, it will be appreciated that the male and female shelf locators may be provided at or near an upper or lower side or face of the shelf alike, with the shelf in the attached configuration, among other possibilities.

Preferably, however, said male and female shelf locators will be provided at corresponding opposed x-y positions on either face of the shelf, respectively.

In other words, pairs of male and female shelf locators are preferably to have the same x-y coordinates, with the faces of the shelf extending parallel to a notional x-y plane, and the notional z axis denoting an out-of-plane direction.

This not only facilitates operation, in that attaching the removable shelf in the desired position on the container wall (or other removable shelf already attached to it) may become more intuitive for the user, but one or more further removable shelves may then be attached to the removable shelf via one or more free male and/or female shelf locators of each pair, which would be free to accommodate any additional shelves on a free face (i.e., a back or an external face, for example) of the removable shelf.

The at least one male shelf locator may be provided generally in the form of a pin.

The at least one female shelf locator may define a slot, which slot may preferably have a shape complementary to said pin, for attachment one to the other.

These shapes may be particularly simple and therefore user friendly.

Advantageously, the pin may comprise an enlarged head portion and the complementary slot may comprise a mouth with an opening on an edge of the shelf, such as the upper edge of the shelf, said mouth or opening being adapted to receive at least the enlarged head portion of the pin.

This may additionally facilitate operation, in that the user may then be able to easily identify the shelf locators, both on the shelf and/or the container wall, or intermediate shelf attached to the container wall, and/or this may allow the user to understand intuitively how to attach the removable shelf in the desired configuration.

Preferably, the enlarged head portion may be provided at a distance from the shelf face. Accordingly, a narrow or stem pin portion may join the enlarged pin head and the face of the shelf. This may prevent the removable shelf from becoming easily or involuntarily detached or disassembled, once the shelf has been attached in place.

Advantageously, the pin may be adapted to define a dovetail coupling when the pin is received in a complementary slot provided on said container wall or on said intermediate removable shelf, or when the slot receives a complementary pin of a further removable shelf.

Dovetail couplings are known in many arts. However, their characteristics are very advantageous when used to attach removable shelves as described herein, since dovetail couplings or joints may help the user to identify the require manner of attachment, including its direction and orientation.

Preferably, said dovetail coupling may comprise a clearance, so that the removable shelf can be attached and detached with maximum ease.

Preferably, the pin may have a generally T-shaped cross-section to better prevent detachment, for example by means of an unwanted or unintended out-of-plane force (acting along the z axis).

Advantageously, the pin and the complementary slot may have respective lengths extending across the removable shelf.

Preferably, said lengths may extend perpendicularly to the side or edge of the removable shelf.

This may further facilitate operation of the shelf in that these lengths will then also indicate to the user a direction of attachment, which may be in the x-y plane of the shelf, and also the extent of movement required for the shelf to be properly attach in the appropriate position on the container wall or on the intermediate removable shelf attached to said wall. The pin may even comprise a tapering or stepped cross-section along the length of the pin, to further facilitate insertion of the pin in the corresponding slot.

These lengths of the pin and slot may be adapted such that a shelf edge, such as the upper edge of the shelf, may end up flush with a corresponding edge of a further removable shelf, or of the container wall.

Preferably, however, the length of the slot will be greater than the length of the pin, and a depth of insertion of the pin in the x direction of the shelf (which can for example be the vertical direction) will be determined by the length of the slot.

The length of the pin (along a nominal x axis of the shelf) may be greater that its transversal width (along a nominal y axis of the shelf) or height (along a nominal z axis of the shelf) of the pin (20, 21).

This provides for optimal dimensioning of the pin, in relation to the likely forces acting during transportation of the removable shelf, when in the attached configuration.

The removable shelf may be provided in the form of a substantially integral or continuous panel of material, preferably made of a rigid plastic.

The removable shelf may further comprise at least one handle and/or at least one rest for accommodating the removable shelf within the rigid containers, for supporting any goods to be transported.

According to another aspect of the present disclosure, there is provided a rigid container for transporting dry goods, the rigid container comprising a container wall having at least one shelf locator as described herein, for receiving at least one removable shelf as described herein.

The rigid container may comprise at least one removable shelf as described herein.

The at least one removable shelf may be disposed within the rigid container and be adapted to divide an enclosed space defined by the rigid container into two or more compartments.

Alternatively, the at least one removable shelf may be attached face-to-face to the container wall, such as to an external face of the container wall, or to an intermediate removable shelf, as described herein.

Advantageously, the rigid container may be foldable.

The rigid container may be at least partially folded, for example it may be completely folded and/or folded on a base of the rigid container.

Advantageously, the rigid container may comprise a container cap, or lid.

The container base may comprise one or more markings, wherein the one or more markings and the cap/lid may be adapted to indicate a number of removable shelves stacked within the rigid container, when the rigid container is completely folded and capped, ready for reverse transportation or for initial deployment.

According to another aspect of the present disclosure, there is provided a stack comprising an at least partially folded rigid container as described herein.

According to another aspect of the present disclosure, there is provided a method of preparing for reverse logistics a rigid container comprising one or more removable shelves as described herein, each comprising at least one shelf locator as described herein, the method comprising:

using the at least one shelf locator, attaching at least one removable shelf face-to-face to a wall of the container, or to an intermediate removable shelf attached to said wall.

The rigid container may be foldable, and the method may thus further comprise:

folding said wall, optionally on a base of the rigid container.

According to another aspect of the present disclosure, there is provided a method of preparing a rigid container for transporting dry goods, the container having one or more removable shelves as described herein, each comprising at least one shelf locator as described herein, via which shelf locator(s) said one or more removable shelves are attached face-to-face to at least one wall of the container, or to an intermediate removable shelf attached to said wall, the method comprising:

detaching at least one removable shelf from said at least one wall or intermediate removable shelf via the one or more shelf locators;

placing the removable shelf in an enclosed space defined by the rigid container, thereby creating two or more compartments.

Advantageously, the rigid container may be folded, and the method may further comprise:

erecting said wall, optionally from a folded configuration in which said wall is laid on or over a base of the rigid container.

The optional and/or preferred features for each aspect of the disclosure set out herein are also applicable to any other aspects of the invention.

Specific embodiments of the present invention will now be described, by way of example only, with reference to the accompanying drawings in which:

SPECIFIC DESCRIPTION

Figure 1:
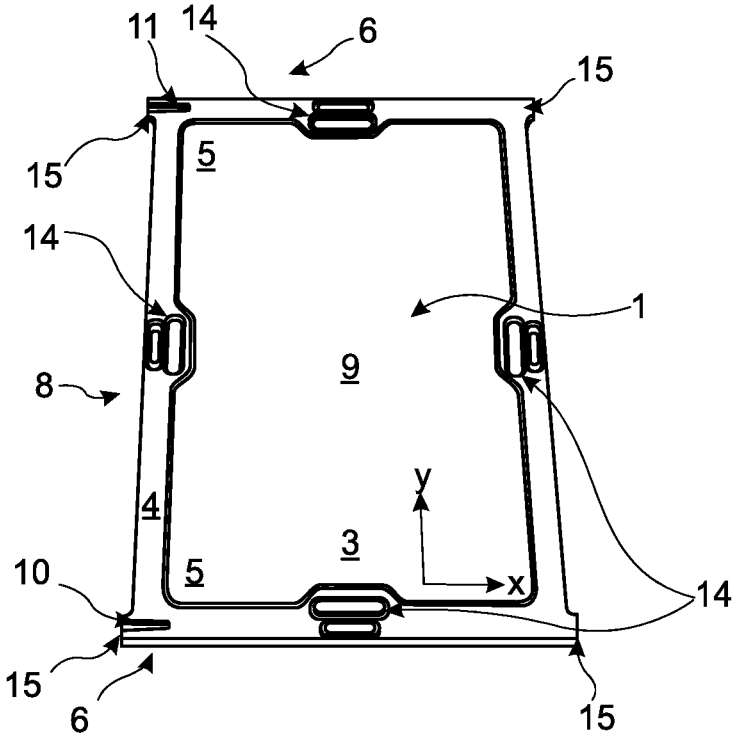
FIG. 1 is a front perspective view of a removable shelf described herein.

In an attempt to reduce misplaced or lost removable shelves for rigid containers for the transportation of dry goods, the inventors have appreciated that it may be desirable to provide a removable shelf 1, 2 with one or more shelf locators 10, 11 as shown in FIG. 1. FIG. 1 shows a removable shelf 1, 2 for rigid containers for dry goods. The described removable shelf 1, 2 is essentially a continuous panel 9 which may be made from one or more rigid pieces of plastics. The removable shelf 1, 2 may thus come as a single or integral panel 9 or may be assembled and/or assemblable from a number of subcomponents. It will be appreciated that the removable shelf 1, 2 may be manufactured according to different methods or techniques and may be made of or include parts which are not made of plastics, although for the present purposes and applications plastics are advantageous since they may readily provide light weight and suitable rigidity, as known in the arts.

The removable shelf 1, 2 comprises at least one shelf locator 10, 11. Each shelf locator 10, 11 or the shelf locators 10, 11 collectively, are usable by a user after removing the removable shelf 1, 2 from the container to prevent the removable shelf 1, 2 from becoming misplaced or lost. To do so, the user can attach the removable shelf 1 to the container, as will be described further below, via the shelf locator(s) 10, 11. The removable shelf 1, 2 can thus be easily located. A removable shelf 1, 2 may comprise two and only two shelf locators 10, 11 which may be provided on a front face 3 of the shelf 1. However, a different number of shelf locators would likewise be possible, as an example just one. In the removable shelves 1, 2 described herein, for example, there are actually provided four shelf locators 10, 11, 12, 13 in total, on each removable shelf 1, 2—in the form of two front shelf locators 10, 11 as shown in FIG. 1, provided on the front face 3 of the shelf 1, 2 and two rear shelf locators 12, 13 provided on a rear shelf face 3, which are not shown in FIG. 1 but can be seen in FIGS. 3 and 4. The importance of the rear shelf locators 12, 13 is that a further removable shelf 1, 2 may then be attached to any removable shelf 1, 2. Before describing further the removable shelf 1, the shelf locators 10, 11 and the containers, a few definitions which will help to describe particularly the removable shelf 1, 2 will now be introduced.

The removable shelf 1, 2 comprises a pair of opposed faces 3 (only one being shown in FIG. 1) one of which, in use (as an upper face), provides support for goods (not shown).

The faces 3 are surrounded by an edge 8, which delimits the removable shelf 1, 2. FIG. 1 shows a generally rectangular shelf shape, but other shapes are in principle possible.

Also, each removable shelf 1, 2 may be provided as a complete shelf, or a complete shelf may be made up of two or more smaller shelves that together may provide the required supporting surface. The edge 8 surrounds the rectangular removable shelf 1 on each of its four sides 4. Each shelf face 3, accordingly also has corresponding rectangular face sides 4. In the described removable shelf 1, 2 the shelf locators 10, 11, 12, 13 are provided at opposed ends 6 of the shelf 1, near adjacent corners 5 of the shelf 1 and close to the edge 8 and one of the sides 4 of the shelf 1, 2, as shown in FIG. 1. It is possible to define a local, notional system of coordinates x-y on the removable shelf 1, 2 or on any of its faces 3, as also shown in FIG. 1. The removable shelf 1, 2 has two short sides 4 that extend along the x axis and two long sides 4 that extend along the y axis. The z axis (not shown in FIG. 1, but see FIG. 8) is therefore accordingly designated as an out-of-plane, orthogonal axis with respect to the notional plane x-y defined by the shelf 1, 2 or any of the shelf faces 3.

Returning now to the operation of the removable shelves 1, 2 described herein, the removable shelves 1, 2 can each 1 advantageously be removably attached to a container wall 101, optionally via another shelf 2, i.e. an intermediate shelf 2, already attached to the container wall 101, so that the removable shelf 1 will not be misplaced in relation to the container 100. It will be understood that the removable shelves 1, 2 described herein can be attached one at a time, or simultaneously in groups of pre-attached two or more removable shelves 1, 2.

Figure 2:
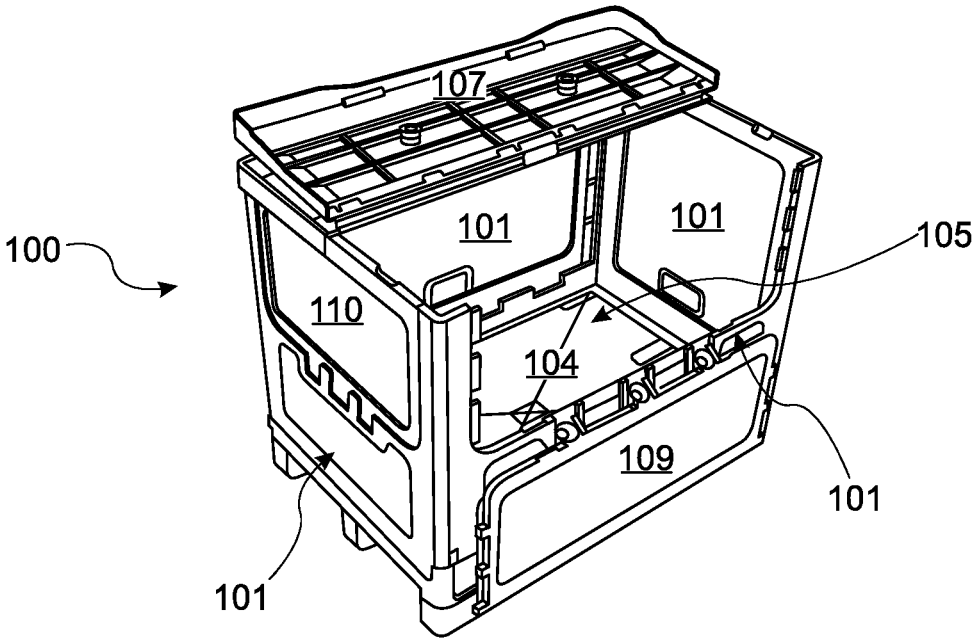
FIG. 2 is a front perspective view of a foldable rigid container for transporting dry goods described herein, with a front door open and a cap or lid partially open.

FIG. 2 shows a rigid container 100 for the transportation of dry goods. Before the shape and function of the shelf locators 10, 11, 12, 13 is described further, the basic topography of the rigid container 100 will be described. The rigid container 100 defines an enclosed space 105 in which goods to be transported can be stored. The enclosed space 105 is delimited laterally by one or more container walls 101, at the bottom by a container base 104, and at the top by a removable container cap or lid 107, which may be foldable in halves longitudinally, as also shown in FIG. 2 to facilitate access to the goods. The front wall 101 incorporates an openable front door 109, which may be opened also to facilitate access to the goods (or any shelves provided inside the container 100, which support these goods). One of the side walls 101 incorporates an openable side door 110, which can be used similarly to the front door 109. One or more removable shelves 1, 2 as described herein can be disposed within the container 100 so as to divide up the enclosed space 105 in two or more compartments 106 respectively, and this will now be better described in connection with FIGS. 3 to 5.

Figure 3:
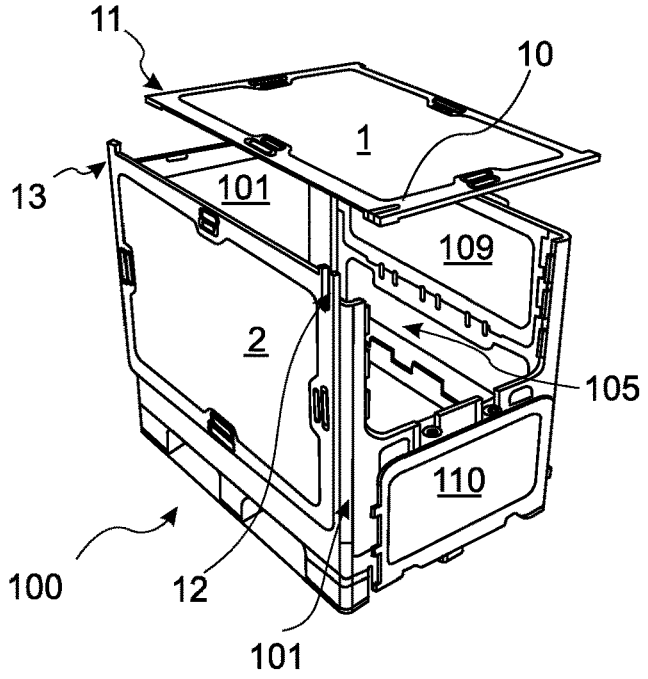
FIG. 3 is a side perspective view of the container of FIG. 2, with a side door open, but showing no lid and two removable shelves, wherein the first removable shelf is attached to a rear wall of the container, and the second removable shelf is being lowered inside the container.
Figure 4:
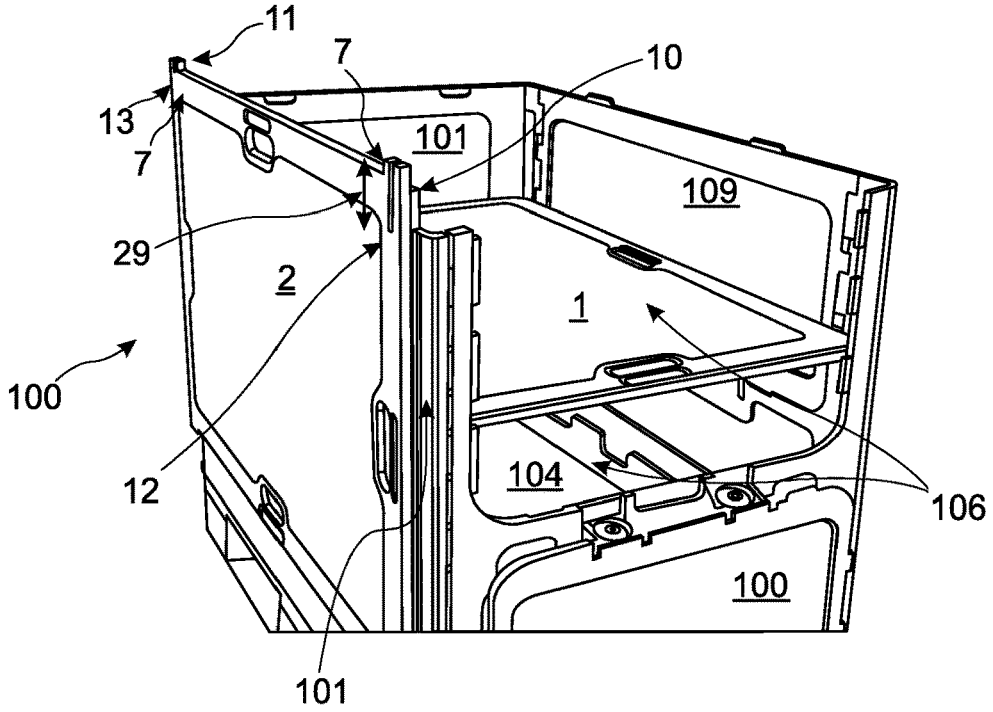
FIG. 4 shows the same container as FIG. 3, with the second removable shelf shown further down towards its resting position within the container.
Figure 5:
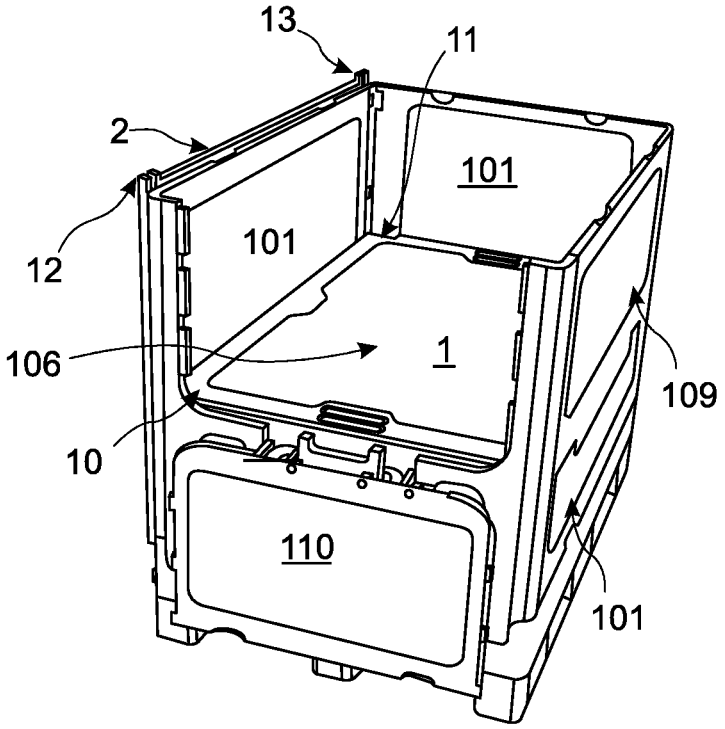
FIG. 5 is a side perspective view of the container of FIGS. 3 and 4, seen from a different angle or side, with the second removable shelf now fully accommodated in position within the container.

FIGS. 3 to 5 show the container of FIG. 2 with one removable shelf 1 being lowered in position inside the container 100 to support the goods. The removable shelf 1 is rested on appropriate protrusions (not described herein) provided internally, along the vertical sides of the container 100, via shelf rests 15 (shown in FIG. 1) disposed on the four corners 5 of the removable shelf 1. This operation is greatly facilitated, as can be imagined, by the provision on the shelf 1 of one or more handles 14 (also shown in FIG. 1). There is another removable shelf 2 shown in FIGS. 3 to 5, and this second removable shelf is attached face-to-face to the rear wall 101 of the container 100 via two of its shelf locators 10, 11 and two corresponding and complementary shelf locators 12, 13 provided on a rear wall 101 of the container 100. This removable shelf 2 also has additional shelf locators 12, 13, which may be similar or the same with respect to the shelf locators 12, 13 provided on the container rear wall 101, which shelf locators 12, 13 are provided on the shelf rear face 3 for receiving the shelf locators 10, 11 of the removable shelf 1 now placed inside the container 100, when the removable shelf 1 will no longer be needed for the transportation of the goods, but will be attached to and stored in the container 100. Vice versa, the now attached removable shelf 2 could be detached from its location on the rear wall 101 of the container 100 and be deployed as an additional shelf 2 inside the container 100, so as to divide the enclosed space 105 not in just two but three compartments 106 for transporting the goods.

It will now be appreciated that the front shelf locators 10, 11 shown in FIGS. 1 and 3 to 5 are male shelf locators 10, 11 adapted to be received in corresponding female shelf locators 12, 13 provided on an edge of the container wall 101, or on the edge 8 of the intermediate shelf 2 attached to the container wall 101. Also, the edge 8 of the shelves 1, 2 close to the shelf locators 10, 11 is an upper edge of the shelf 1, 2, when the shelf 1, 2 is vertically attached to the container wall 101, face-to-face, as shown in FIGS. 3 to 5. However, these configurations are not mandatory.

The one or more male shelf locators 10, 11 could for example be replaced by one or more female shelf locators 12, 13 on one of the shelf faces 3, and vice versa the one or more female shelf locators 12, 13 on the other face 3 of the shelf 1, 2 or on the container wall 101 could for example be replaced by one or more corresponding male shelf locators 10, 11, so long as the shelf locator(s) 10, 11, 12, 13 are collectively usable to attach (in the particular case of the described shelf 1, 2, attach by hanging) the shelf 1, 2 to the container wall 101 or to one or more intermediate shelves already hung to said container wall 101. It is therefore important that the shelf locator(s) 10, 11, 12, 13 are positioned and shaped to achieve this outcome, independently of their specific conformation and x-y position on the shelf 1, 2.

It is also similarly not mandatory that the shelf locator(s) 10, 11, 12, 13 be disposed close to the upper side 4 or edge 8 of the shelf 1, 2, in the configuration where the shelf 1, 2 is vertically attached face-to-face to the rear wall 101 of the container 100; the shelf locator(s) 10, 11, 12, 13 could otherwise be disposed close to a bottom edge or side of the shelf 1, 2, or laterally. It is however important that the male shelf locator(s) 10, 11 and female shelf locator(s) 12, 13 be disposed in spatially corresponding positions 7 on the x-y nominal plane of the removable shelves 1, 2, such that the male and female shelf locators 10, 11, 12, 13 may form, in use, pairs of engaged male-female shelf locators 10, 12; 11, 13 for attaching the panels 9 as desired on the containers 100. Such positions are shown in FIG. 4, for example.

The advantages brought forward by providing shelf locators 10, 11, 12, 13 as described herein resonate with the provision of a foldable container 100. With a foldable container 100, at least one of the container walls 101 is folded so that the container 100 can be configured into a more compact form for transportation back to a service centre, together with any attached removable shelves 1, 2. Any removable shelves 1, 2 can therefore be neatly stored away in the folded container 100. At the service centre, the use cycle of the container 100 may start again: the containers 100 would first be reconditioned and then shipped to a place of use, where they would be erected and loaded with the goods to be transported. The removable shelves 1, 2 at this moment will still be stacked inside the container 100 but will be ready to be installed in the enclosed space 105 when the container is prepared for transporting the goods.

In principle, any manner of removably attaching the shelf face-to-face to the container wall or to an intermediate shelf attached to the container wall may be considered. Further, multiple shelves could alternatively be attached to multiple container walls, and these multiple container walls may all be individually collapsible. An advantageous way of removably attaching the shelf face-to-face against the container wall or to another shelf is by simply hanging the shelf. Alternative to the designs described herein, therefore, it will be appreciated that the shelf locators may each be provided in the form of a hanger or a hook. In such cases, the shelves 1, 2 may be directly hung to the container wall 101, or to any intermediate shelves, internally or externally, without the need for corresponding shelf locators, such as the female shelf locators 12, 13 described herein.

Figure 6:
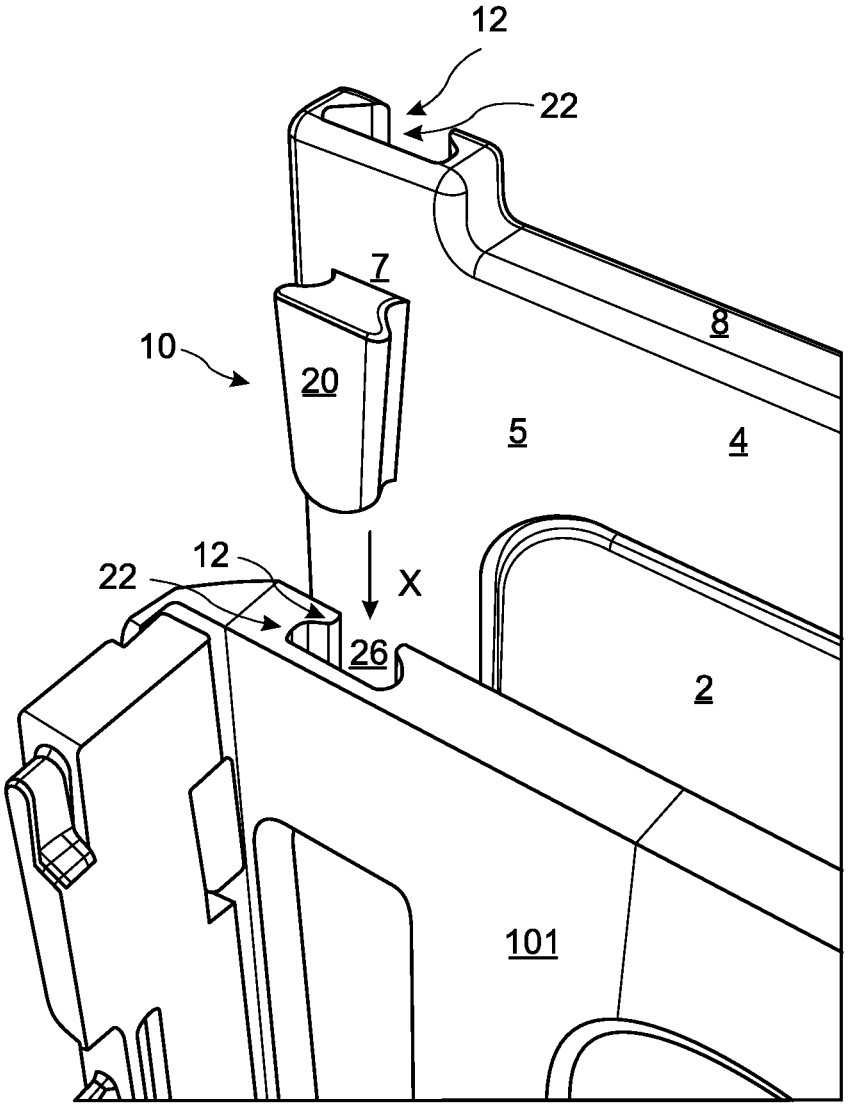
FIG. 6 is an expanded perspective view of a portion of the container of FIGS. 3 to 5, showing the first removable shelf being attached to the rear wall of the container.
Figure 7:
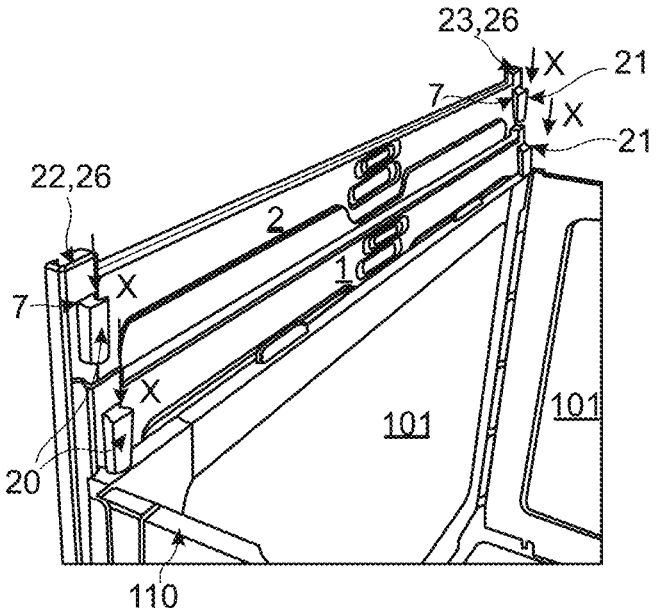
FIG. 7 is an expanded perspective view of the container of FIGS. 3 to 6, showing how the first and second removable shelves can be both (one at a time or simultaneously) attached to the rear wall of the container.
Figure 8:
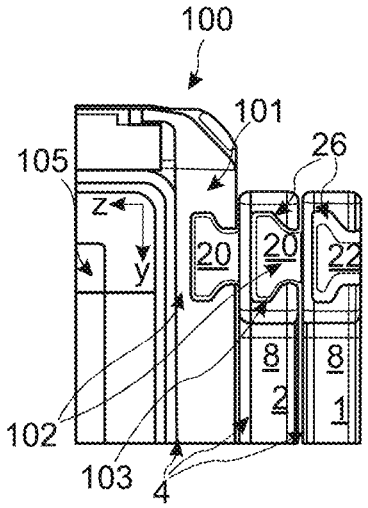
FIG. 8 is a top plan view of a portion of the container of FIGS. 3 to 7, showing details of the first and second removable shelves attached to the container.
Figure 9:
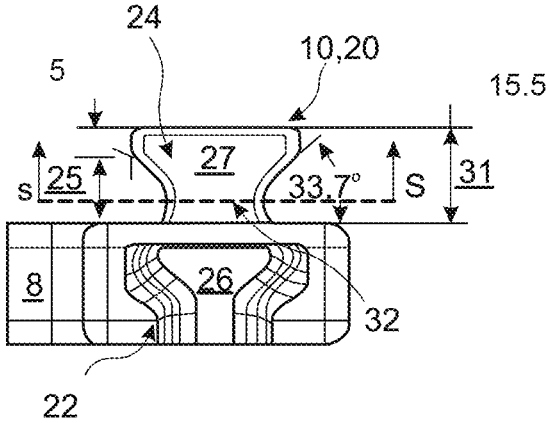
FIG. 9 is an elevation of a portion of the removable shelf of FIG. 1.
Figure 10:
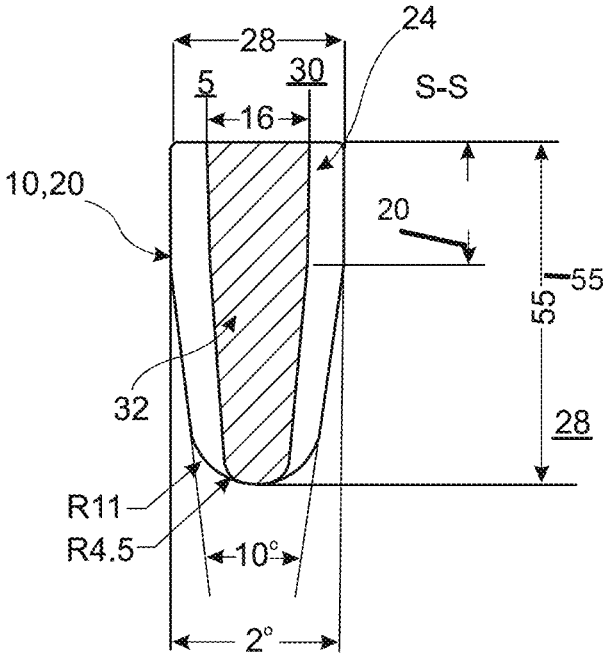
FIG. 10 is a cross-section of one of the shelf locators of the shelf of FIGS. 1 and 9, along line S-S shown in FIG. 9.

With reference now to FIGS. 6-10, the at least one male shelf locator 10, 11 is provided, in the described shelves 1, 2, generally in the form of a pin 20, 21 (best shown in FIGS. 6, 9 and 10). The at least one female shelf locator 12, 13 is instead provided generally in the form of a slot 22, 23, which in shape is at least to some extent complementary to that of the pin 20, 21 so that the pin 20, 21 can be straightforwardly and intuitively received in the slot 20, 21, so that the shelves 1, 2 can as a consequence be attached as intended.

Each pin 20, 21 comprises an enlarged head portion 24 and each complementary slot 22, 23 comprises an opening in the form of a mouth 26, that opens on the edge 8 of the shelf 1, 2, (or of the container wall 101, in case this shelf locator 12, 13 is provided thereon). This mouth or opening 26 is adapted to receive at least the enlarged head portion 24 of the pin 20, 21 but may otherwise receive all of the pin 20, 21. The mouth 26 enables attachment of the removable shelf 1, 2 by the user engaging each pin 20, 21 with the respective slot 22, 23 and then sliding the pin 20, 21 in the x direction shown by the arrows in FIGS. 6 and 7. As shown in FIG. 9, the enlarged head portion 24 of the pin 20, 21 is a distance 25 from the face 3 of the shelf 1, 2 on which this shelf locator 10, 11 is provided. A narrow or stem pin portion 32 joins the enlarged pin head 24 and the face 3 of the shelf 1, 2. A user is accordingly able to easily identify the shelf locators 10, 11, 12, 13, 20, 21, 22, 23 both on the shelf and/or the container wall, or intermediate shelf attached to the container wall, and to use them in the intended manner. Further, the enlarged head portion 24 of the pin 20, 21 prevents the removable shelf 1, 2 from becoming easily or involuntarily detached or disassembled, once the shelf 1, 2 has been attached in place as intended. It will not be possible to detach the shelf 1, 2 by pulling the shelf 1, 2 in the z direction shown in FIG. 8. To detach any of the shelves 1, 2 shown for example in FIG. 7, the user will need to slide one shelf 1, 2 at a time, or both shelves 1, 2 together along the x axis, in a direction which is reverse to that of the arrows shown.

To put it in other words, the pin 20, 21 and the corresponding slot 22, 23 are adapted to define a dovetail coupling 102 when the pin 20, 21 is received in the slot 22, 23. This coupling is best identified by FIG. 8. The coupling also has a suitable level of clearance 103 to facilitate insertion and removal of the pin 20, 21 from the corresponding slot 22, 23.

Alternatively, the pin could have had a cylindrical shape and the slot the shape of a correspondingly cylindrical cavity and the shelf could have been placed in the intended position by translation and coupling along the z axis. An alternative manner of retention could have been devised, for example in the form of an interference fitting between the pin and the slot, but this would have been a less preferred solution.

Returning to the dovetail coupling 102 described herein, it will be noticed that each pin 20, 21 has a generally T-shaped cross section 27, as best seen in FIG. 9. Each pin 20, 21 has a corresponding pin width 30 and pin height 31. Other shapes would, however, have been possible (although they may have been less preferred). For example, the pin 20, 21 (and with it, the corresponding slots 22, 23) could have had a generally trapezoidal shape. All the dimensions quoted in FIGS. 9 and 10 are in millimetres (mm). For example, with reference to FIG. 10, it can be seen that that each pin 20 has a length 28 along the x axis equal to 55 mm. The pin tapers in this direction from about half-way down. This makes insertion of the pin 20 into the corresponding slot 22 easier. The length 28 of the pin 20 in the x direction is important in that, together with the corresponding length 29 of the slot 22 (this can be seen in FIGS. 4 and 11) determines the exact position of attachment of the shelf 1, 2 relative to the container wall 101, or in relation to any intermediate shelves, along the x axis. It may be desirable for the shelves 1, 2, for maximum compactness to have flush or substantially flush edges 8 in the attached configuration. The same consideration applies in relation to the edge of the container wall 101. The pins 20, 21 and slots 22, 23 extend linearly in the x direction, and this further facilitates operation of the removable shelves 1, 2 in that attachment or connection can then be achieved with a single, straightforward movement, after each pin 20, 21 is located in place on the mouth 26 of the slots 22, 23. So that the pins 20, 21 may be sufficiently visible and structurally capable of supporting any forces likely to act on them (not only during attachment, but also during transport, for example), the length of the pin 29 is greater than its transversal width 30 or height 31, as also shown in FIG. 9.

Figure 11:
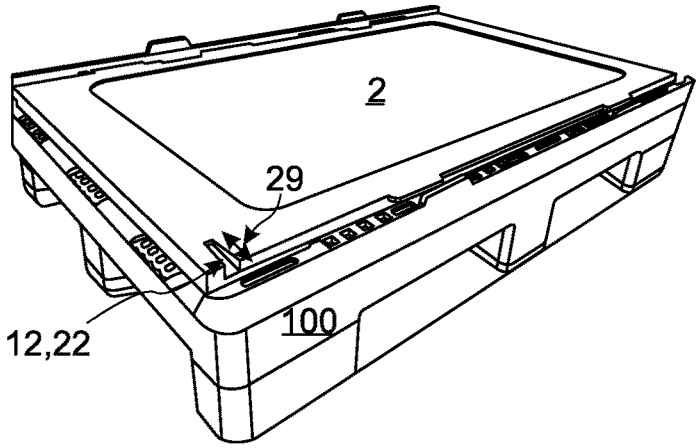
FIG. 11 is a front perspective view of the container of FIGS. 3 to 8 in a collapsed configuration, without the lid, showing a first removable shelf stacked and stored inside the container.
Figure 12:
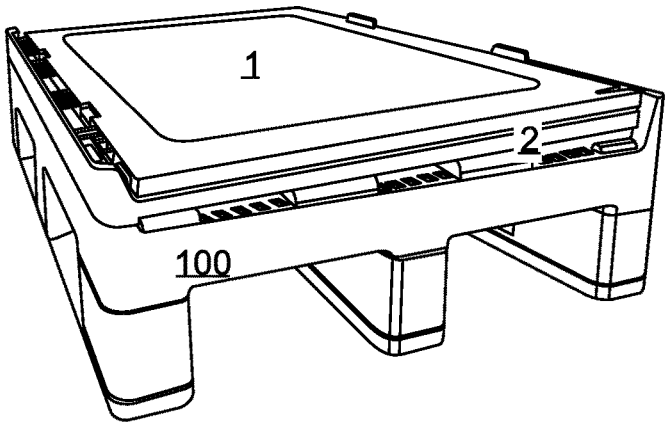
FIG. 12 is a side perspective of the container of FIG. 11, showing a second removable shelf stacked on the first removable shelf, also stored inside the container.
Figure 13:
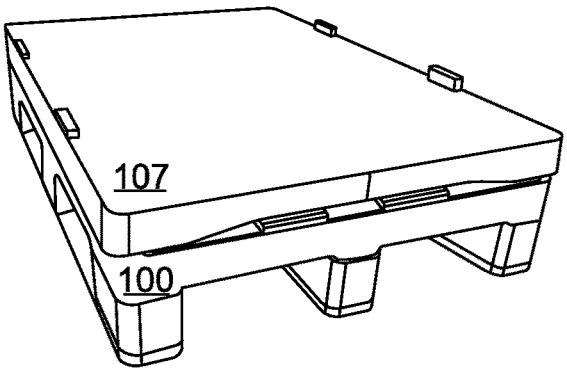
FIG. 13 shows the container of FIG. 12, with the lid on, in a ready-for-transportation configuration.
Figure 14:
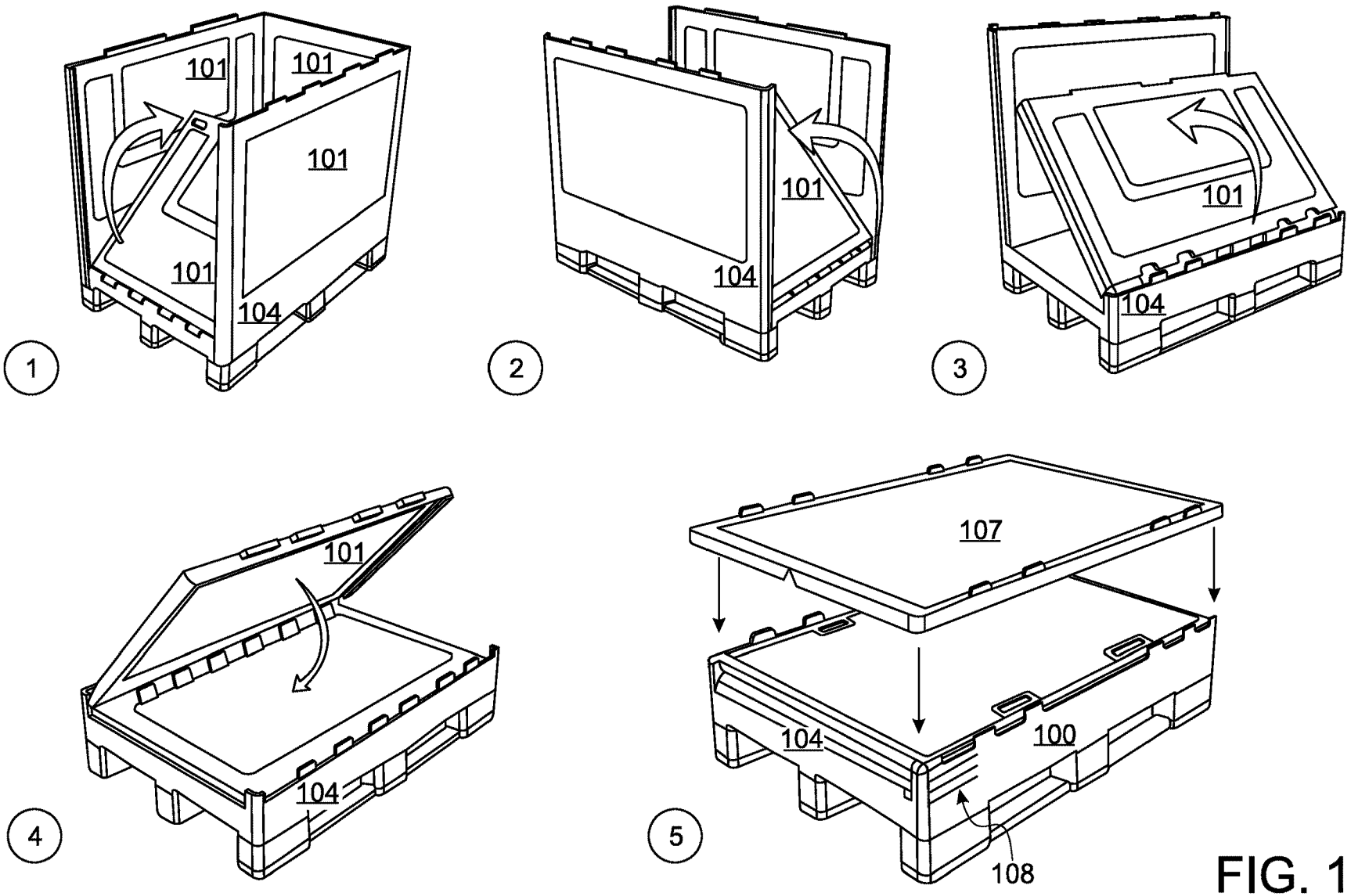
FIG. 14 illustrates a method of collapsing, or folding, a foldable rigid container as described herein, in preparation for transportation; and, FIG. 15 illustrates a folding sequence similar to that shown in FIG. 14, but in addition showing how a user can attach a removable shelf to a wall of the container (frames 1 to 7) or detach the removable shelf from said wall as part of a process of erecting a shelved container (frame 8) for starting a new transportation cycle.

The containers 100 described herein are fully collapsible, as shown by FIGS. 11, 12 and 13. With fully collapsible, we meant that the containers 100 described herein can be fully folded on their base 104, as shown in FIG. 14. The cap or lid 107 can then be placed on the collapsed or folded container as shown in FIG. 13, for example. In FIG. 11, only one removable shelf 2 is stored inside the folded container 100. However, FIG. 12 demonstrates that two or more shelves 1, 2 may be stored in a stacked configuration inside the folded container 100. An interesting feature arises from the fact that the lid or cap 107 will take a different position vertically, on the folded container 100, depending on the number of removable shelves 1, 2 stored and stacked inside the folded container 100. This can be used to provide visual information to a user as regards the number of removable shelves 1, 2 stacked inside the folded container 100. FIG. 14-5 shows a set of markings 108 provided on the base 104 of the container 100. The markings 108 are disposed such that a curtain 111 that at least partially surrounds the lid 107 will cover one, more or all of the markings 108 such that any visible markings 108 will correspond to the number of shelves 1, 2 stored in the folded container 100.

FIG. 14, and particularly FIGS. 14-1 to 14-4, illustrate schematically a method of preparing for reverse logistics a foldable rigid container 100 comprising one or more removable shelves 1, 2 as described herein, each comprising at least one shelf locator 10, 11, 12, 13 as described herein. The container 100 is folded, in this example, by folding in turn the side walls (FIGS. 14-1 an 14-2) one on the other, and both over the base 104 of the container 100, then by folding the front and back walls over said side walls, as shown in FIGS. 14-3 an 14-4. All the walls are hinged, but the details of these hinges (as well as the hinge of the lid 107) are not within the scope of the present specification.

Alternatively, the walls 101 may be collapsible in different fashion, for example by removing each of the walls 101 or all of the walls collectively altogether from the base 104 of the container 100 and lying them flat over this base 104. Using the at least one shelf locator 10, 11, 12, 13 as described herein, although not visible in FIG. 14 the user has attached at least one removable shelf 1, 2 face-to-face to at least one of said walls 101 of the container 101, or to an intermediate shelf as described herein. The removable shelf 1, 2 is then folded over the base 104 alongside the respective side wall 101 of the container 100.

Figure 15:
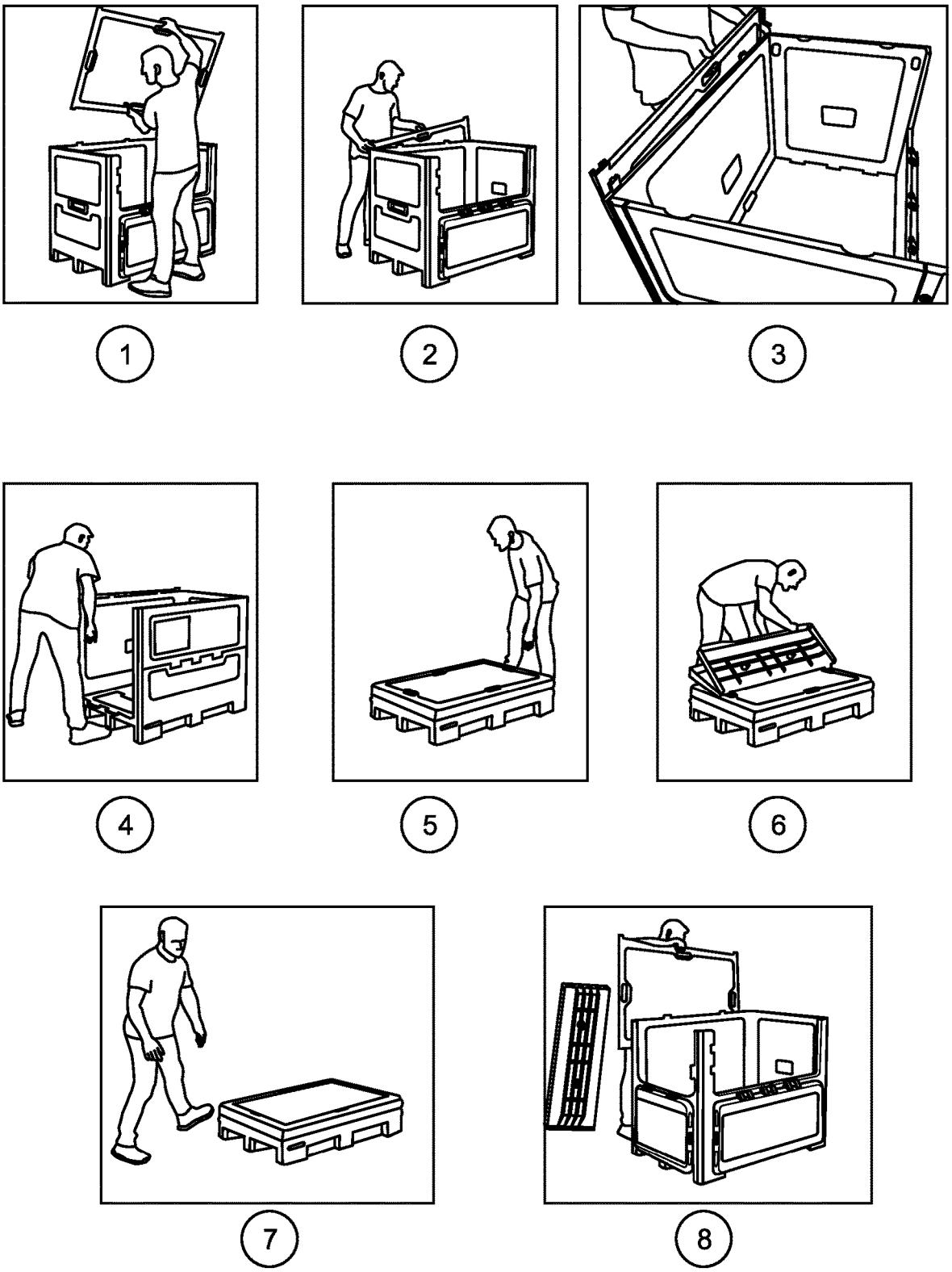

FIG. 15 exemplifies a method of dismantling a foldable container 100 having one or more removable shelves 1, 2 similar to those described herein, and in addition shows (FIG. 15-8) a first step for preparing the foldable rigid container 100 for transporting dry goods. The container has two removable shelves 1, 2 as described herein, each comprising at least one shelf locator 10, 11, 12, 13 as described herein, via which shelf locator(s) said one or more removable shelves 1, 2 can be attached face-to-face to at least one wall 101 of the container 100, or to an intermediate removable shelf attached to said wall 101.

In FIG. 15-1, the user, having previously removed the lid 107 from the container 100, and opened the front door 109 of the container, provides to remove a removable shelf 1 from within the container 100. In FIGS. 15-2 and 15-3, operating first on one of the shelf locators 10, and then on the other 11, the user attaches the removable shelf 1 to the rear wall 101 of the container, as previously described. Then, in FIG. 15-4, the user proceeds to fold a first side wall 101 of the container 100, similar to the step in FIG. 14-1. Successively, the container 100 is folded flat, with the removable shelf 1 being visible on top of the folded side walls 101 (FIG. 15-5). At this point, the lid 107 is put back on the folded container 100 (FIG. 15-6), and the considerations made above in connection with FIG. 14-5 likewise apply to this step and the next step (FIG. 15-6) where the folded container 100 is shown in its configuration ready to be transported back to a service centre for restarting a transportation cycle (although the markings are not visible in FIG. 15). Imagining that the folded container 100 has now been transported back to the service centre, and has been reconditioned, if required, or otherwise serviced, the container 100 can now be newly erected as shown in FIG. 15-8, wherein the user now detaches the removable shelf 1, 2 from the container wall 101 so that he or she can then proceed to reinstall the removable shelf 1, 2 in position within the container 100 for supporting goods to be loaded onto the shelf.

LIST OF REFERENCE SIGNS

1 First removable shelf
2 Second (intermediate) removable shelf
3 Shelf face
4 Side of shelf (or of face of shelf)
5 Shelf corner
6 End of shelf
7 Corresponding positions on shelf faces
8 Shelf edge
9 Shelf panel
10, 11 First and second male shelf locators
12, 13 First and second female shelf locators
14 Shelf handle
15 Shelf rest
20, 21 First and second pins
22, 23 First and second slots
24 Enlarged head portion of pin
25 Distance related to head portion of pin
26 Mouth of slot
27 Cross section of pin
28 Pin length
29 Slot length
30 Pin width
31 Pin height
32 Stem of pin (narrow portion of pin)
100 Container
101 Container wall
102 Dovetail coupling
103 Clearance
104 Container base
105 Enclosed space of container
106 Compartment of container
107 Container cap or lid
108 Markings
109 Front door of container
110 Side door of container
111 Lid curtain

The invention claimed is:

1. A rigid container (100) for transporting dry goods, the rigid container (100) comprising:

at least one removable shelf (1) comprising at least one shelf locator (10, 11) usable such that the removable shelf can be attached face-to-face to a wall of a rigid container, or to an intermediate removable shelf attached in the same face-to-face manner to said wall of said rigid container; and a container wall (101) having at least one shelf locator (12, 13) for receiving the at least one removable shelf (1), wherein one or more of:

the at least one removable shelf (1) is disposed within the rigid container (100) and is adapted to divide an enclosed space (105) defined by the rigid container (100) into two or more compartments (106); or the at least one removable shelf (1) is attached face-to-face to an external face (103) of the container wall (101).

2. The rigid container of claim 1, wherein the at least one shelf locator (10, 11) is provided on a face (3) of the removable shelf (1);

optionally, at or near a side (4) thereof, optionally, at or near a corner (5) thereof.

3. The rigid container of claim 2, wherein the removable shelf (1) comprises at least two shelf locators (10) disposed at or near opposed ends (6) of the shelf (1), respectively;

optionally, along said side (4);

optionally, or at or near adjacent corners (5) of the shelf (1).

4. The rigid container of claim 1, wherein the removable shelf (1) comprises at least one male shelf locator (10, 11) and at least one complementary, female shelf locator (12, 13), said male and female shelf locators (10, 11; 12, 13) being provided at corresponding opposed positions (7) on either face (3) of the shelf (1), respectively.

5. The rigid container of claim 4, wherein the at least one male shelf locator (10, 11) is provided generally in the form of a pin (20, 21), and the at least one female shelf locator (12, 13) defines a slot (22, 23) complementary to said pin (20, 21).

6. The rigid container of claim 5, wherein the pin (20, 21) comprises an enlarged head portion (24) and the complementary slot (22, 23) comprises a mouth (26) that opens on an edge (8) of the shelf (1), said mouth (26) being adapted to receive said enlarged head portion (24);

optionally, wherein the enlarged head portion (24) is a distance (25) from the shelf face (3).

7. The rigid container of claim 6, wherein the pin (20, 21) is adapted to define a dovetail coupling (102) when the pin (20, 21) is received in a complementary slot (22, 23) provided on said container wall (101) or on said intermediate removable shelf (2), or when the slot (22, 23) receives a complementary pin (20, 21) of a further removable shelf (2') attached to the removable shelf (1);

optionally, wherein said dovetail coupling (102) comprises a clearance (112);

optionally, wherein the pin (20, 21) has a generally T-shaped cross-section (27).

8. The rigid container of claim 6, wherein the pin (20, 21) and the complementary slot (22, 23) have respective lengths (28, 29) extending across the removable shelf (1);

optionally, wherein said lengths (28, 29) extends perpendicularly to the side (4) or edge (8) of the removable shelf (1).

9. The rigid container of claim 8, wherein the pin (20, 21) comprises a tapering cross-section (27) along the length (28) of the pin (20, 21).

10. The rigid container of claim 8, wherein said lengths (28, 29) are adapted such that the shelf edge (8) may be flush with a corresponding edge (8') of a further removable shelf (2') attached to the removable shelf (1);

optionally, wherein the length (29) of the slot (22, 23) is greater than the length (28) of the pin (20, 21).

11. The rigid container of claim 8, wherein the length (28) of the pin (20, 21) is greater that a transversal width (30) or height (31) of the pin (20, 21).

12. The rigid container of claim 1, the removable shelf (1) being provided in the form of a substantially integral or continuous panel (9) of material, preferably made of a rigid plastic.

13. The rigid container of claim 1, wherein the removable shelf (1) further comprises at least one handle (14) or at least one rest (15) for accommodating the removable shelf (1) within the rigid containers (100).

14. The rigid container (100) of claim 1, wherein the rigid container (100) is foldable.

15. The rigid container (100) of claim 1, wherein:

the rigid container (100) is at least partially folded;

optionally, wherein the rigid container (100) is completely folded;

optionally, wherein the rigid container is completely folded on a base (104) of the rigid container (100).

16. The rigid container (100) of claim 1, wherein the rigid container (100) comprises a container cap (107).

17. The rigid container (100) of claim 15, wherein the container base (104) comprises one or more markings (108), wherein the one or more markings (108) and the cap (107) are adapted to indicate a number of removable shelves (1, 2, 2') stacked within the rigid container (100), when the rigid container (100) is completely folded and capped.

18. A stack (200) comprising an at least partially folded rigid container (100) according to claim 15.

19. A method of preparing for reverse logistics the rigid container of claim 1, the method comprising:

using the shelf locator (10, 11), attaching the at least one removable shelf (1) face-to-face to the wall (101) of the container (100), or to an intermediate removable shelf (20) attached face-to-face to said wall.

20. The method of claim 19, wherein the rigid container (100) is foldable and the method further comprises:

folding said wall (101), optionally on or over a base (104) of the rigid container (100).

21. A method of preparing the rigid container (100) of claim 1 for transporting dry goods, the method comprising:

detaching the at least one removable shelf (1) from said said at least one wall (101) or said intermediate removable shelf (2) via the one or more shelf locators (10, 11);

placing the detached at least one removable shelf (1) in an enclosed space (105) defined by the rigid container (100), thereby creating two or more compartments (106).

22. The method of claim 21, wherein the rigid container (100) is folded and the method further comprises:

erecting said wall (101), optionally from a base (104) of the rigid container (100).

* * * * *